United States Patent [19]

Shinopulos et al.

[11] Patent Number: 4,736,789

[45] **Date of Patent: * Apr. 12, 1988**

[54] APPARATUS AND METHOD FOR CONTINUOUS CASTING OF METALLIC STRANDS AT EXCEPTIONALLY HIGH SPEEDS USING AN OSCILLATING MOLD ASSEMBLY

[75] Inventors: George Shinopulos; M. Ronald Randlett, both of Burlington; Terry F. Bower, Needham, all of Mass.

[73] Assignee: Kennecott Corporation, Cleveland, Ohio

[ * ] Notice: The portion of the term of this patent subsequent to Jul. 8, 1997 has been disclaimed.

[21] Appl. No.: 841,690

[22] Filed: Mar. 19, 1986

Related U.S. Application Data

[60] Continuation of Ser. No. 418,707, Sep. 16, 1982, abandoned, which is a division of Ser. No. 157,933, Jun. 9, 1980, abandoned, which is a continuation-in-part of Ser. No. 928,881, Jul. 28, 1978, Pat. No. 4,211,270.

[51] Int. Cl.[4] ..... B22D 11/04

[52] U.S. Cl. ..... 164/416; 164/443

[58] Field of Search ..... 164/484, 485, 478, 459, 164/488, 418, 443, 439, 416, 413

[56] References Cited

U.S. PATENT DOCUMENTS 2,135,183 11/1938 Junghans .
2,135,184 11/1938 Junghans .
2,136,394 11/1938 Poland et al. .

(List continued on next page.)

FOREIGN PATENT DOCUMENTS 145879 8/1948 Australia .
217474 3/1957 Australia .
33958 5/1973 Australia .
936670 11/1973 Canada .
969731 6/1975 Canada .
1944762 9/1969 Denmark .
1914300 3/1969 Fed. Rep. of Germany .
1944762 9/1969 Fed. Rep. of Germany .
2060451 12/1970 Fed. Rep. of Germany .
2746393 10/1977 Fed. Rep. of Germany .
48-14293 5/1973 Japan ..... 164/443
531514 1/1941 United Kingdom .
1014001 8/1962 United Kingdom .
1014003 12/1965 United Kingdom .
1087026 10/1967 United Kingdom .

OTHER PUBLICATIONS

Rantanen, Mauri, "The Upcast Method of Producing Copper Wire", *Wire Industry*, Jul. 1976, pp. 565–567.

Schmitz-Steger, "Rolling of Bar, Rod and Section: Copper and Copper Alloys", *Metals Technology*, Jul.-Aug., 1975, pp. 382–395.

*Primary Examiner*—Kuang Y. Lin
*Attorney, Agent, or Firm*—Lorusso & Loud

[57] ABSTRACT

An oscillating cooled mold assembly for the continuous, high-speed casting of metallic strands, especially upcasting strands of copper alloys such as brass, has a hollow die in fluid communication with a melt typically held in a casting furnace. A coolerbody surrounds the die in a tight-fitting relationship to form a solidification front in the melt as it advances through the casting zone of the die. During assembly, the die is preferably slip fit in the coolerbody. A shoulder on the die engages a lower face of the coolerbody and, together with a small irregularity on the upper coolerbody wall, prevents any axial movement of the die before it thermally expands against the coolerbody. An insulating member located between the die and the coolerbody and below the solidification front fixes the location of the front within a dimensionally uniform area of the die. The insulating member is preferably a ring of a material such as cast silica that has a low coefficient of thermal expansion, a low porosity, and is highly resistant to thermal shock. The insulating member also preferably creates a steel longitudinal temperature gradient at its upper end to promote a high cooling rate over a relatively short casting zone. An insulating hat encloses the coolerbody, allowing it to be immersed in the melt and preferably deeply immersed to a level above the casting zone. The strand or rod formed from the solidified melt is pulled through the die while the mold oscillates in a direction substantially parallel to the direction of travel of the rod.

65 Claims, 10 Drawing Sheets

U.S. PATENT DOCUMENTS 2,171,132 8/1939 Simons .
2,405,355 8/1946 Harrison .
2,553,921 5/1951 Jordan ..... 164/421
2,740,177 4/1956 Smart, Jr. .
2,815,551 12/1957 Hessenberg et al. .
2,871,534 2/1959 Wieland .
3,162,907 12/1964 Maier et al. .
3,164,896 1/1965 Fullman .
3,210,812 1/1968 Berwick, Jr. .
3,287,773 11/1966 Woodburn, Jr. .
3,300,824 1/1967 Ross .
3,302,252 2/1967 Woodburn, Jr. .
3,340,925 9/1967 Woodburn, Jr. .
3,354,936 11/1967 Atkin .
3,363,669 1/1968 Wertli ..... 164/443 X
3,410,333 11/1968 Woodburn, Jr. .
3,429,365 2/1969 Schrewe .
3,461,943 8/1969 Shile .
3,520,352 7/1970 Hess .
3,545,528 12/1970 Chang .
3,565,154 2/1971 Kuratomi .
3,566,951 3/1971 Schrewe .
3,669,176 6/1972 Krall et al. .
3,700,024 10/1972 Knell .
3,721,288 3/1973 Vogt et al. .
3,746,077 7/1973 Lohikoski et al. ..... 164/421
3,780,789 12/1973 Unger .
3,782,446 1/1974 Walter .
3,817,313 6/1974 Gamble et al. .
3,863,700 2/1975 Bedell et al. .
3,866,570 2/1975 Cruzado et al. .
3,872,913 3/1975 Lohikoski ..... 164/64
3,881,554 5/1975 Botta, Jr. et al. .
3,893,502 7/1975 Slamar .
3,908,747 9/1975 Kuttner .
3,930,533 1/1976 Rokop et al. .
3,938,583 2/1976 Kavesh .
4,073,333 2/1978 Korshunov et al. .
4,197,900 4/1980 Bloshenko et al. ..... 164/514 X
4,211,270 7/1980 Shinopulos et al. .
4,216,818 8/1980 Wilson .
4,232,727 11/1980 Bower et al. .

APPARATUS AND METHOD FOR CONTINUOUS CASTING OF METALLIC STRANDS AT EXCEPTIONALLY HIGH SPEEDS USING AN OSCILLATING MOLD ASSEMBLY

This is a continuation of application Ser. No. 418,707, filed Sept. 16, 1982, abandoned, which is a division, of application Ser. No. 157,933, filed June 9, 1980, now abandoned, which is a continuation-in-part of application Ser. No. 928,881, filed July 28, 1978, now U.S. Pat. No. 4,211,270, the teachings of which are incorporated herein by reference.

BACKGROUND OF THE INVENTION

This invention relates in general to casting of metallic strands and more specifically to a system using a cooled oscillating mold assembly for the continuous, high speed casting of strands of copper and copper alloys including brass.

It is well known in the art to cast indefinite lengths of metallic strands from a melt by drawing the melt through a cooled mold. The mold generally has a die of a refractory material such as graphite cooled by a surrounding water jacket. U.S. Pat. No. 3,354,936, for example, describes a cooled mold assembly sealed into the bottom wall of the melt container to downcast large billets. The force of gravity feeds the melt through the mold. In downcasting, however, there is a danger of a melt "break out" and the melt container must be emptied or tilted to repair or replace the mold or the casting die.

Horizontal casting through a chilled mold has also been tried. Besides the break out and replacement problems of downcasting, gravity can cause non-uniform solidification, resulting in a casting that is not cross-sectionally uniform or having an inferior surface quality.

Finally, various arrangements have been used for upcasting. Early efforts are described in U.S. Pat. Nos. 2,553,921 to Jordan and 2,171,132 to Simons. Jordan employs a water cooled, metallic "mold pipe" with an outer ceramic lining that is immersed in a melt. In practice, no suitable metal has been found for the mold pipe, the casting suffers from uneven cooling, and condensed metallic vapors collect in a gap between the mold pipe and the liner due to differences in their coefficients of thermal expansion. Simons also uses a water-cooled "casing", but it is mounted above the melt and a vacuum is required to draw melt up to the casting. A coaxial refractory extension of the casing extends into the melt. The refractory extension is necessary to prevent "mushrooming", that is, the formation of a solid mass of the metal with a diameter larger than that of the cooled casing. As with Jordan, thermally generated gaps, in this instance between the casing and the extension, can collect condensed metal vapors which results in poor surface quality or termination of the casting.

U.S. Pat. Nos. 3,746,077 and 3,872,913 describe more recent upcasting apparatus and techniques. The '913 patent avoids problems associated with thermal expansion differences by placing only the tip of a "nozzle" in the melt. A water-cooled jacket encloses the upper end of the nozzle. Because the surface of the melt is below the cooling zone, a vacuum chamber at the upper end of the nozzle is necessary to draw the melt upwardly to the cooling zone. The presence of the vacuum chamber, however, limits the rate of strand withdrawal and requires a seal.

The '077 patent avoids the vacuum chamber by immersing a cooling jacket and a portion of an enclosed nozzle into the melt. The immersion depth is sufficient to feed melt to the solidification zone, but it is not deeply immersed. The jacket, as well as the interfaces between the jacket and the nozzle, are protected against the melt by a surrounding insulating lining. The lower end of the lining abuts the lower outer surface of the nozzle to block a direct flow of the melt to the cooling jacket.

The foregoing systems are commonly characterized as "closed" mold, in that the liquid metal communicates directly with the solidification front. The cooled mold is typically fed from an adjoining container filled with the melt. In contrast, an "open" mold system feeds the melt, typically by a delivery tube, directly to a mold where it is cooled very rapidly. Open mold systems are commonly used in downcasting large billets of steel, and occasionally aluminum, copper or brass. However, open mold casting is not used to form products with a small cross section because it is very difficult to control the liquid level and, hence, the location of the solidification front.

A problem that arises in closed mold casting is a thermal expansion of the bore of the casting die between the beginning of the solidification front and the point of complete solidification termed "bell-mouthing". This condition results in the formation of enlargements of the casting cross section which wedge against a narrower portion of the die. The wedged section can break off and form an immobile "skull". The skulls can either cause the strand to terminate or can lodge on the die and produce surface defects on the casting. Therefore, it is important to maintain the dimensional uniformity of the die bore within the casting zone. In the '913 and '077 systems, these problems are controlled by a relatively gentle vertical temperature gradient along the nozzle due in part to a modest cooling rate to produce a generally flat solidification front. With this gentle gradient, acceptable quality castings can be produced only at a relatively slow rate, typically five to forty inches per minute.

Another significant problem in casting through a chilled mold is the condensation of metallic vapors. Condensation is especially troublesome in the casting of brass bearing zinc or other alloys bearing elements which boil at temperatures below the melting temperature of the alloy. Zinc vapor readily penetrates the materials commonly used to form casting dies, as well as the usual insulating materials, and can condense to liquid in critical regions. Liquid zinc on the die near the solidification front can boil at the surface of the casting, resulting in a gassy surface defect. Because of these problems, present casting apparatus and techniques are not capable of commercial production of good quality brass strands at high speeds.

The manner in which the casting is drawn through the chilled mold is also an important aspect of the casting process. A cycled pattern of a forward withdrawal stroke followed by a dwell period, is used commercially in conjunction with the mold unit described in the aforementioned U.S. Pat. No. 3,872,913. U.S. Pat. No. 3,908,747 discloses a controlled reverse stroke to form the casting skin, prevent termination of the casting, and compensate for contraction of the casting within the die as it cools. British Pat. No. 1,087,026 also discloses a reverse stroke to partially remelt the casting. U.S. Pat. No. 3,354,936 discloses a pattern of relatively long forward strokes, followed by periods where the casting motion is stopped and reversed for a relatively short stroke. This pattern is used in downcasting large billets to prevent inverse segration. In all of these systems, however, the stroke velocities and net casting velocities are slow. In the '936 system, for example, forward strokes are three to twenty seconds in duration, reverse strokes are one second in duration, and the net velocity is thirteen to fifteen inches per minute.

It is known to oscillate a continuous casting mold to provide stripping action to facilitate the movement of the newly cast rod through the mold and more importantly, when the rate of advancement of the mold during a portion of the cycle is greater than that of the rod being cast, to prevent tension tears in the solidifying skin. Moreover, creating the casting strokes by mold oscillation allows the rod to be withdrawn from the mold at a constant rate, thereby facilitating further processing operations after casting, for example, the conversion of rod to strip. A particularly suitable design for an oscillating mold assembly is disclosed in a pending U.S. patent application Ser. No. 117,028, filed Jan. 31, 1980, for "Oscillating Mold Casting Apparatus", having a common assignee as this application. The teachings of that application are hereby incorporated by reference.

It is, therefore, a principal object of this invention to provide a cooled mold assembly and method for the continuous casting of high quality metallic strands, and particularly those of copper and copper alloys including brass, at production speeds many times faster than those previously attainable with closed mold systems.

It is a further object of this invention to provide such a mold assembly, which oscillates in substantially the same direction as the rod being cast with little or no lateral movement.

Another object of the invention is to provide such a cooled mold assembly for upcasting with the mold assembly oscillating and immersed in the melt.

A further object is to provide such a mold assembly that accommodates a steep temperature gradient along a casting die, particularly at the lower end of a solidification zone, without the formation of skulls or loss of dimensional uniformity in the casting zone.

Still another object is to provide a casting withdrawal process for use with such a mold assembly to produce high quality strands at exceptionally high speeds.

A further object is to provide a mold assembly with the foregoing advantages that has a relatively low cost of manufacture, is convenient to service and is durable.

SUMMARY OF THE INVENTION

An oscillating cooled mold assembly for continuous high-speed casting of metallic strands has a hollow die formed of a refractory material. A melt, typically of copper or copper alloys such as brass, is in fluid communication with one end of the die. A coolerbody, preferably water-cooled, encloses the die in a tight-fitting relationship. The coolerbody has a high cooling rate that produces a solidification front within a casting zone of the die spaced from the die end adjacent the melt. Means are provided for drawing the melt through the mold assembly to effect solidification of a rod or strand. The mold assembly is supported for oscillation in a direction substantially parallel to the direction of travel of the rod through the mold, and the means by which the mold assembly is caused to oscillate as the rod or strand advances creates the effect of both forward and reverse casting strokes. By oscillating the mold while withdrawing the rod or strand at a constant velocity, the relative motion between mold and rod is controllable over a wide range. Means are provided to deliver coolant to the chilled mold during oscillation.

In a preferred embodiment of the invention, a coolant manifold extension assembly communicates with, and supplies coolant to, the coolerbody. The manifold extension assembly in turn attaches to a support manifold which supplies the extension assembly with coolant. An insulating hat surrounds the coolerbody and manifold extension assembly, thermally insulating them from the metallic melt. The insulating hat attaches the support manifold by spring biased mounting means. The manifold extension assembly features three concentric tubes forming two annular elongated passageways therebetween, with one of the annular passageways being adapted for supplying coolant to the coolerbody, and the other passageway being adapted for receiving the coolant from the coolerbody. The two inner tubes fit slidably into O-ring gland seals in the support manifold.

The means for accomplishing mold oscillation includes at least one hydraulic actuator controlled by a servo valve and computer means. Mold oscillation wave forms can be shaped to provide unlimited variation in stripping velocity, return velocity and dwell. This is extremely useful in determining optimum mold motion programs for different casting alloys.

The die preferably has a longitudinally uniform cross section. It can have a slight upwardly narrowing taper or stepped configuration on its inner surface. The die is preferably slip fit into the coolerbody to facilitate replacement. Before the die expands thermally against the coolerbody, it is restrained against axial movement by a slight upset in the mating coolerbody wall near the top and a stepped outer surface that engages the lower face of the coolerbody. Also, in the preferred form a metallic foil sleeve is interposed between the outside insulating member and the counterbore to facilitate removal of the insulator.

The coolerbody preferably has a double wall construction with an annular space between the walls. The inner wall adjacent the die is preferably formed from a sound ingot of age hardened chrome copper alloy; the outer sleeve is preferably formed of stainless steel. The inner and outer walls or "bodies" are preferably bonded at their lower ends by a copper/gold braze joint. Water is typically circulated in a temperature range and flow rate that yields a high cooling rate of the melt advancing through the die while avoiding condensation of water vapor on the mold assembly or the casting. A vapor shield and gaskets are preferably disposed between the immersed end of the cooler body and the surrounding insulating hat.

These and other objects and features of the invention will become apparent to those skilled in the art from the following detailed description which should be read in light of the accompanying drawings.

DETAILED DESCRIPTION OF THE PREFERRED EMBODIMENTS

Figure 1:
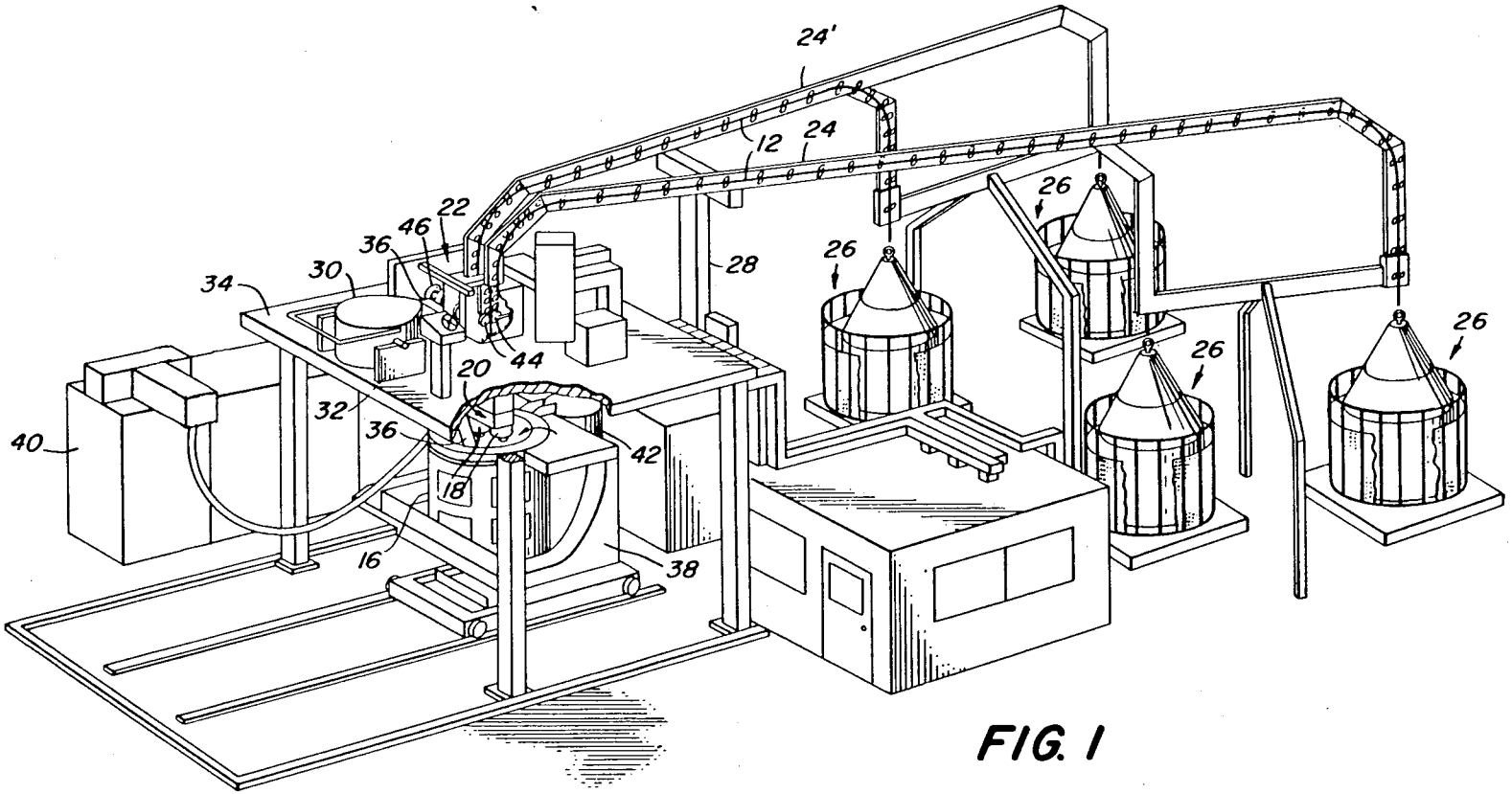
FIG. 1 is a simplified view in perspective of a strand production facility that employs oscillating mold assemblies and methods embodying the present invention.

FIG. 1 shows a suitable facility for the continuous production of metallic strands in indefinite lengths by upwardly casting the strands through cooled molds according to this invention. Four strands 12 are cast simultaneously from a melt held in a casting furnace 16. The strands, which can assume a variety of cross sectional shapes such as square or rectangular, and diameters will be described as rods having a substantially circular cross section with a diameter in the range of one-quarter to two inches.

With reference to FIG. 1, the strands 12 are cast in four cooled mold assemblies 18 mounted on four vertically movable carriage assemblies 20. A withdrawal machine 22 draws the strands at a constant rate through the mold assemblies and directs them to a pair of booms 24, 24' that guide the strands to four pouring type coilers 26 where the strands are collected in coils. Each boom 24 is hollow to conduct cooling air supplied by the ducts 28 along the length of the boom.

The melt is produced in one or several melt furnaces (not shown) or in one combination melting and holding furnace (not shown). While this invention is suitable for producing continuous strands formed from a variety of metals and alloys, it is particularly directed to the production of copper alloy strands, especially brass. A ladle 30 carried by an overhead crane (not shown) transfers the melt from the melt furnaces to the casting furnace 16. The ladle preferably has a teapot-type spout which delivers the melt with a minimum of foreign material, such as cover and dross. To facilitate the transfer, the ladle is pivotally seated in support cradle 32 on a casting platform 34. A ceramic pouring cup 36 funnels the melt from the ladle 30 to the interior of the casting furnace 16. The output end of the pouring cup 36 is located below the casting furnace cover and at a point spaced from the mold assemblies 18. In continuous production, as opposed to batch casting, additional melt is added to the casting furnace when it is approximately half full to blend the melt both chemically and thermally.

Figure 10:
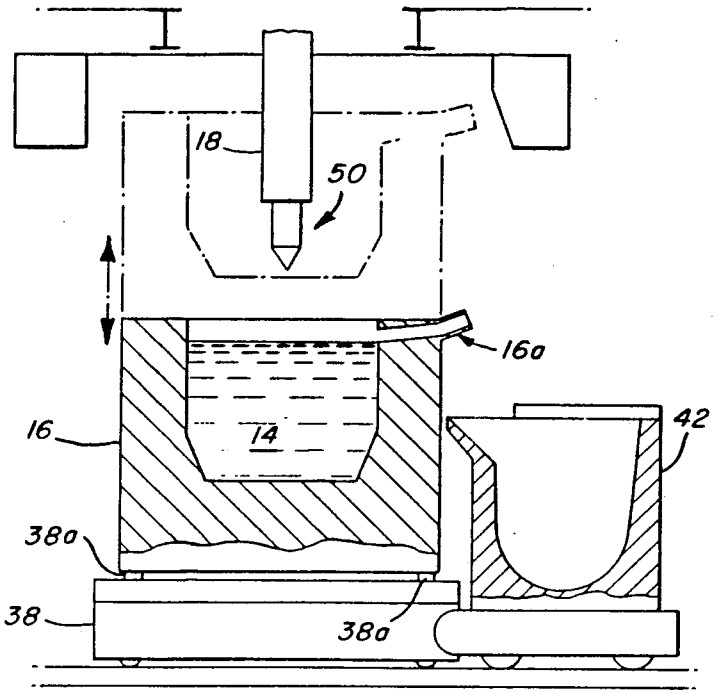
FIG. 10 is a simplified view in vertical section showing the casting furnace shown in FIG. 1 in its lower and upper limit positions with respect to the mold assemblies.

The casting furnace is supported on a hydraulic, scissor-type elevator and dolly 38 that includes a set of load cells **38*a* (FIG. 10) to sense the weight of the casting furnace and its contents. Output signals of the load cells 38*a* are conditioned to control the furnace elevation; this allows automatic control of the level of the melt with respect to the coolerbody. As is best seen in FIG. 10, the casting furnace is movable between a lower limit position in which the mold assemblies 18 are spaced above the upper surface of the melt 14 when the casting furnace is filled and an upper limit position (shown in phantom) in which the mold assemblies are adjacent the bottom of the casting furnace. The height of the casting furnace is continuously adjusted during casting to maintain the selected immersion depth of the mold assemblies 18** in the melt. In the lowered position, the mold assemblies are accessible for replacement or servicing, after the furnace is rolled out of the way.

It should be noted that this production facility usually includes back-up level controls such as probes, floats, and periodic manual measurement as with a dunked wire. These or other conventional level measurement and control systems can also be used instead of the load cells as the primary system. Also, while this invention is described with reference to fixed mold assemblies and a movable casting furnace, other arrangements can be used. The furnace can be held at the same level with melt added periodically or continuously to maintain the same level. Another alternative includes a very deep immersion so that level control is not necessary. A significant advantage of this invention is that it allows this deep immersion. Each of these arrangements has advantages and disadvantages that are readily apparent to those skilled in the art.

The casting furnace 16 is a 38-inch coreless induction furnace with a rammed alumina lining heated by a power supply. A furnace of this size and type can hold approximately five tons of melt. The furnace 16 has a pouroff spout 16*a* that feeds to an overfill and pour-off ladle 42 (FIG. 10).

Referring again to FIG. 1, the withdrawal machine 22 has four opposed pairs of pinch rolls 44 that each frictionally engage one of the strands 12. The pinch rolls 44 are secured on a common shaft driven by a servo-controlled, reversible hydraulic motor 46. A conventional variable-volume, constant-pressure hydraulic pumping unit that generates pressures of up to 3000 psi drives the motor 46. A conventional electronic programmer (not shown) produces a program of signals that controls the operation of the motor 46 through a conventional servo system. The program includes a programmed start-up routine that gradually ramps up the withdrawal speed. The drive rolls 44 can be individually disengaged from a selected strand 12 without interrupting the advance of the other strands.

Figure 2:
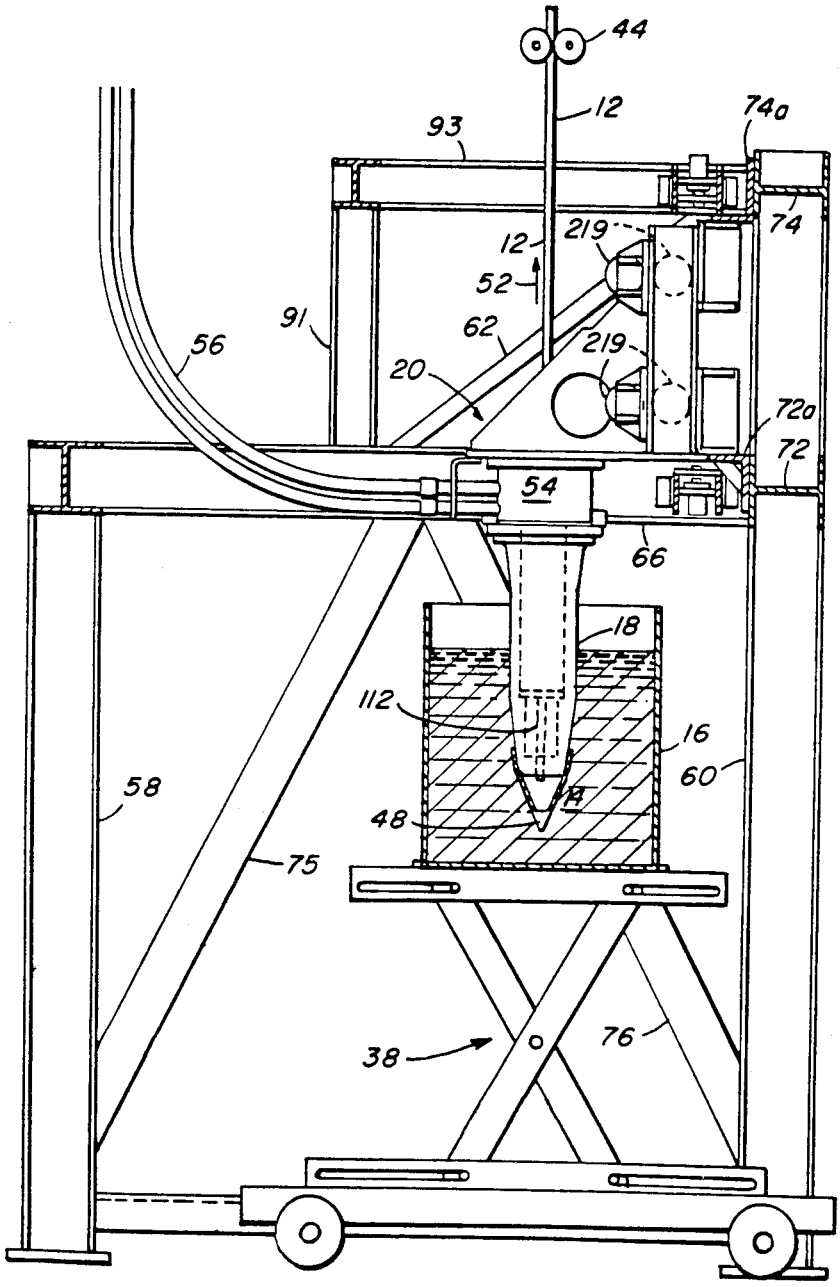
FIG. 2 is a side view partially in section of the oscillating mold and supporting structure in conjunction with a furnace for holding a melt.

Referring now to FIG. 2, a mold assembly 18 is immersed in a melt 14 contained by a furnace 16. FIG. 2 shows a protective cone 48 which melts away after the assembly 18 is immersed in the melt 14. The protective cone 48 is normally formed of copper and takes less than one minute to completely dissolve. The purpose of the protective cone is to prevent dross and other impurities from entering a die 112 upon immersion. Once the assembly is immersed in the melt and the cone has disintegrated, molten metal is drawn through the assembly 18. Initially, the process is started by inserting a solid starter rod (with a bolt on the end of it) through the die 112 from the upper part of the assembly into the melt. Molten metal solidifies on the bolt and, when the rod is pulled through the die 112, the molten metal follows, solidifying on its way. After a solidified rod or strand 12 has been threaded through pinch rolls 44, the starter rod (with a small piece of the strand 12) is severed from the remainder of the strand 12. Once the strand 12 has been formed from the melt 14, it is continuously withdrawn at a constant speed by one or more pairs of the pinch rollers 44. Thus, the strand 12 continuously advances away from the melt at a constant velocity, generally in the range of from 200 to 400 inches per minute in the direction shown by an arrow 52. While the strand 12 is advancing, the entire assembly 18 oscillates in the vertical direction. Basically, the assembly 18 is connected to a carriage assembly 20 for controlled oscillation.

As the chilled mold assembly 18 oscillates, it is cooled by means of a coolant supplied to a manifold 54 mounted to the carriage assembly 20 through flexible tubes 56. The coolant delivery system is specifically described in conjunction with FIGS. 3 and 4.

It should be pointed out that although the production facility of FIG. 1 makes use of four independently oscillating mold assemblies 18 to produce the four strands 12, any other number of mold assemblies may be used in tandem, as dictated by specific production requirements.

Figure 3:
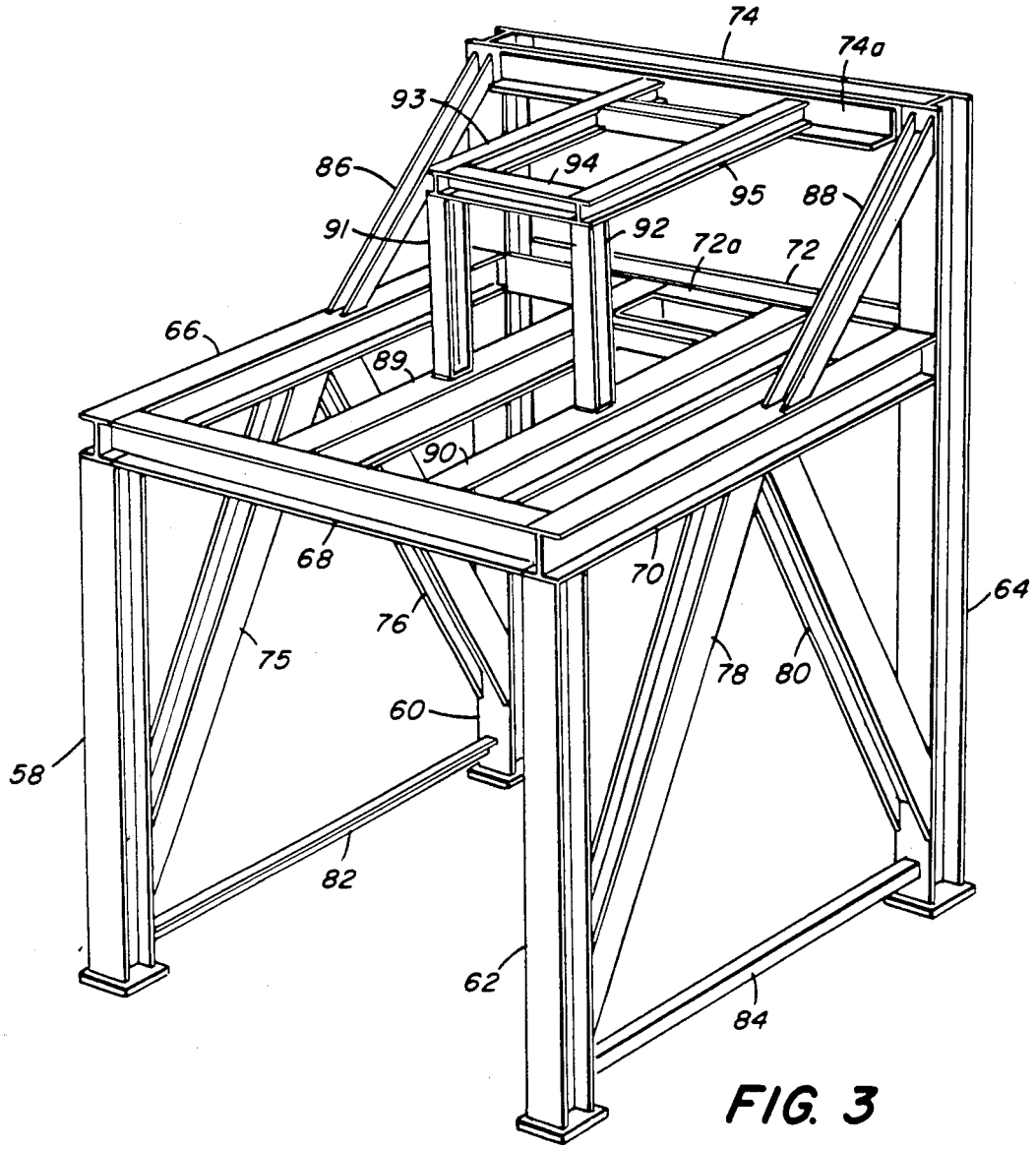
FIG. 3 is a perspective view of the structure for supporting the oscillating mold.

Because the mold assembly 18 oscillates during the casting process, high dynamic loads develop which must be accommodated by the supporting structure. The superstructure which resists these loads with a minimum of deflection, will now be described in detail in cojunction with FIGS. 2 and 3. Referring first to FIG. 3, the overall supporting structure is a rigid steel box. The vertical loads are supported by the columnar structural members 58, 60, 62, 64 which are steel I-beams. The columnar members 58, 60, 62, 64 are tied together by the horizontal steel I-beams 66, 68, 70 and 72. The horizontal members 66, 68, 70, 72 and 74 are preferably welded to the columnar members 58, 60, 62 and 64. The horizontal I-beams 66, 68 and 70 are oriented so that their flange faces extend in the vertical direction for maximum stiffness in carrying the oscillation induced loads. The beams 72 and 74 are further stiffened respectively by angle pieces 72*a* and 74*a* welded to the beams. The beams 66 and 70 are stiffened in the vertical direction by bracing beams 75, 76, 78 and 80, which are also made of steel. Steel beams 82 and 84 further strengthen the structure at its bottom.

The carriage structure is mounted to angle pieces 72*a* and 74*a* which totally support the carriage through horizontal I-beams 72 and 74. Carriage load paths are fed to the frame base through beams 86, 88, 78, 80, 75 and 76. The steel I-beams 89 and 90 are welded between the horizontal beams 68 and 72. These beams 89 and 90 support the oscillating carriage supporting superstructure comprising vertical I-beams 91 and 92 and horizontal I-beams 93, 94 and 95. The beams 93 and 95 are welded to the steel I-beam 74 which connects the columnar beams 60 and 64 at their tops. The structure is rendered more rigid by bracing steel I-beams 86 and 88.

Figure 13:
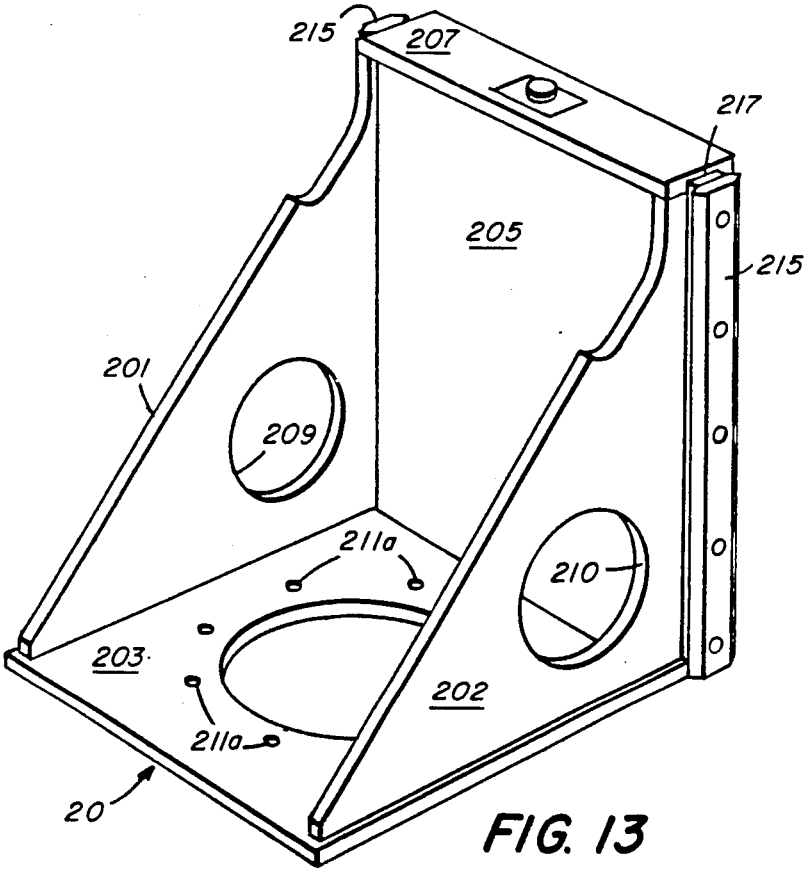
FIG. 13 is a perspective view of the carriage which supports a mold for oscillation.

The carriage assembly 20 (FIG. 2) is shown in greater detail in FIG. 13. This assembly 20 is constructed of steel angle plates 201 and 202 welded to bottom plate 203 and back plate 205. A top plate 207 is welded to the back plate 205 and the angle plates 201 and 202 to complete the structure. The plates 201 and 202, approximately one inch thick, are lightened by means of holes 209 and 210 respectively.

The carriage assembly 20 supports the manifold 54 (FIG. 2) by means of bolts through the bolt holes 211*a* (FIG. 13) which encircle a hole 213 in the bottom plate 203. The hole 213 allows the cast strand to pass through on its way to the pinch rollers 44 (FIG. 2).

Figure 14:
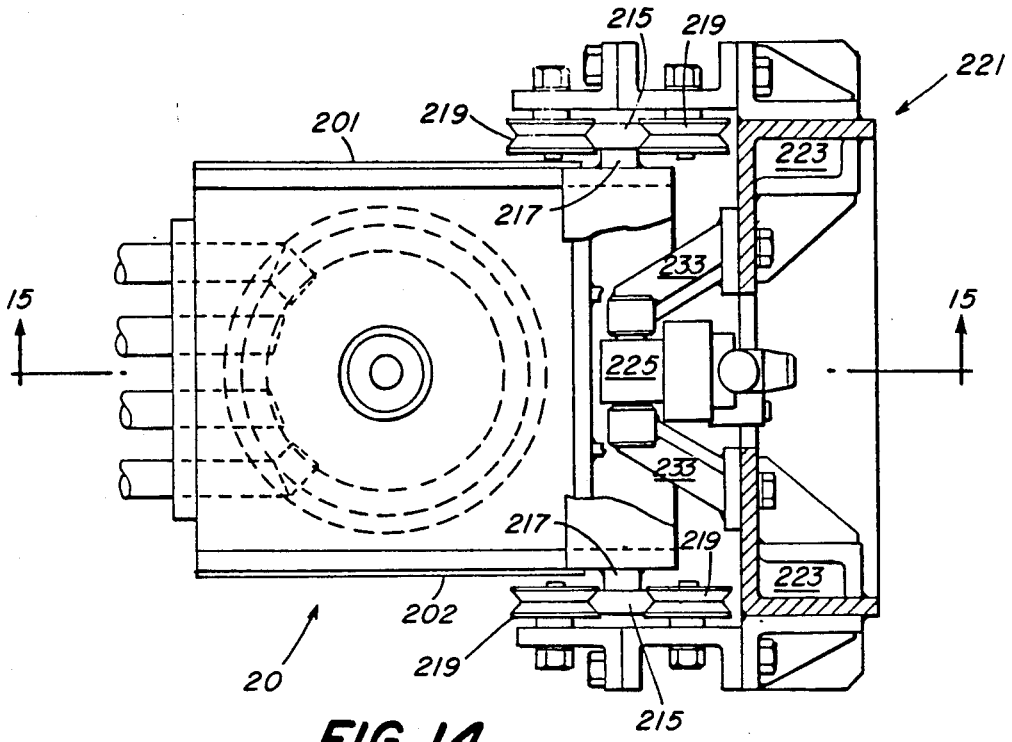
FIG. 14 is an isolated plan view of the carriage assembly of the structure of FIG. 2 for supporting and moving the oscillating mold.

Referring now to FIGS. 13 and 14, the carriage assembly 20 is constrained to move in the vertical direction by rails 215. These rails 215 are spaced apart from the angle plates 201 and 202 by means of spacers 217. The rails 215 and spacers 217 are bolted and doweled to the angle plates 201 and 202.

The rails 215 have bevelled edges which closely engage bevelled idler rollers 219 (FIG. 14). The rollers 219 are bolted to structural assembly 221. The structural assembly 221 includes welded box structures 223 for added rigidity. The structural assembly 221 is bolted rigidly to the superstructure described above in reference to FIG. 3.

Figure 15:
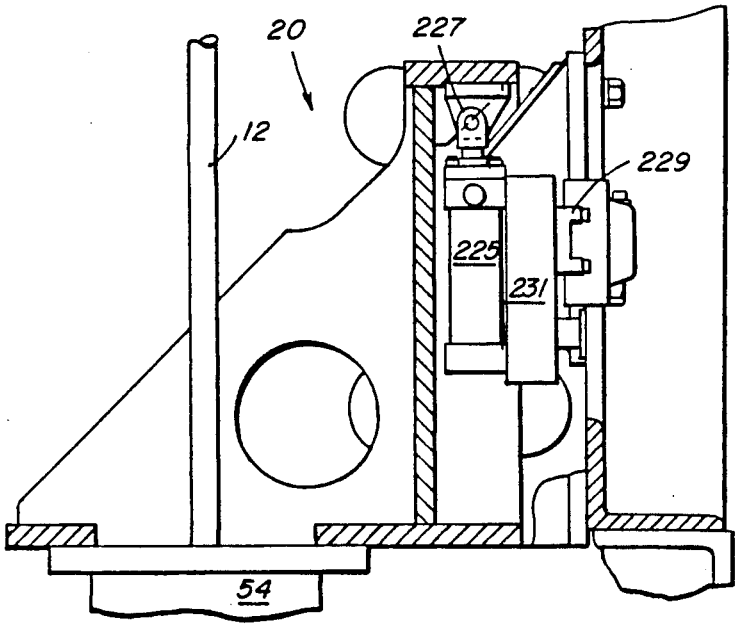
FIG. 15 is a side elevational view, in section, of the carriage assembly of FIG. 14.

With reference to FIGS. 14 and 15, the carriage assembly 20 is supported for oscillation in the vertical direction by hydraulic cylinder 225. The piston within the hydraulic cylinder 225 attaches to the top plate of carriage assembly 20 by means of bracket 227. The hydraulic cylinder 225 is controlled by servo valve 229 through manifold block 231.

The hydraulic cylinder 225 itself is supported by arms 233 (FIG. 14) which are bolted to the structural assembly 221. The servo valve 229 is under the control of a computer (not shown) which commands the desired relative motion between strand and mold for proper solidification of the cast strand. In particular, mold oscillation will create the same effect with respect to the rod or strand 12 as a pattern of forward and reverse strokes of the rod or strand itself.

Figure 9:
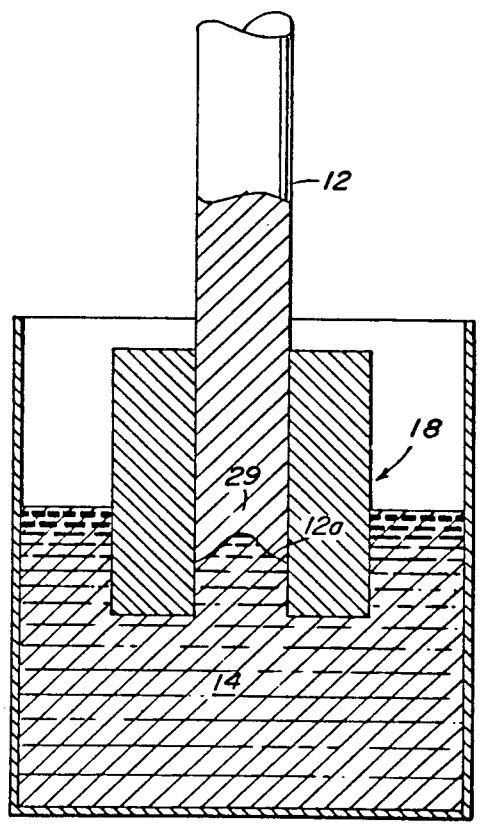
FIGS. 7–9 are diagrammatic representations of the position of the mold in a melt during various stages of mold oscillation.
Figure 8:
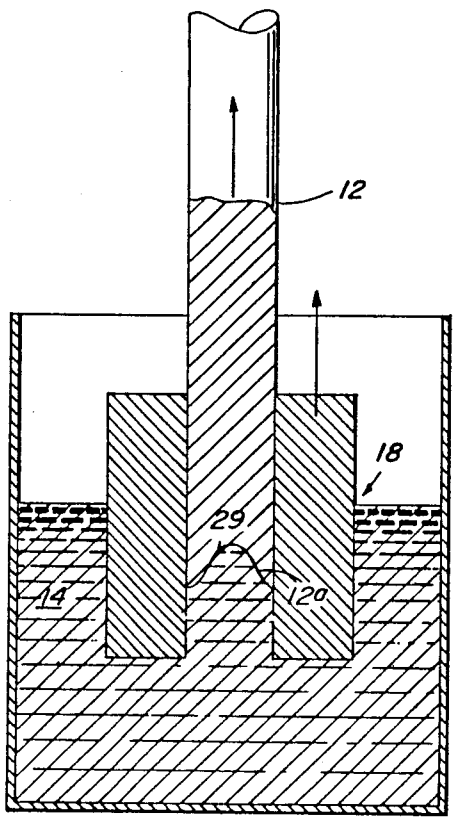
Figure 7:
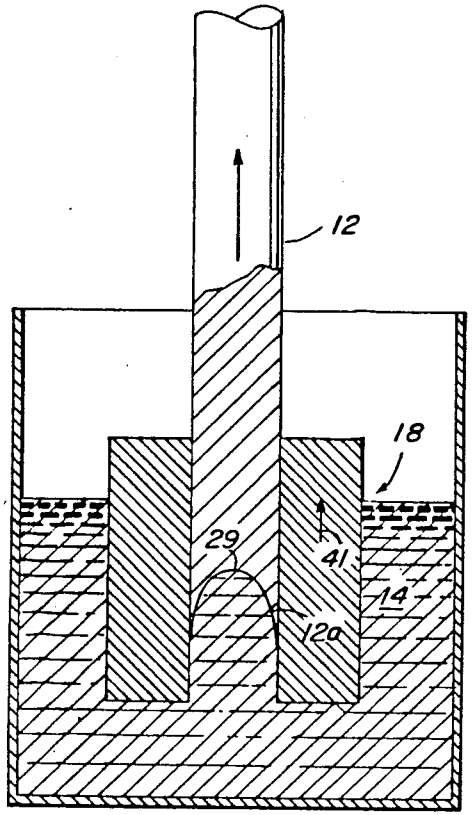

FIGS. 7–9 are provided to show the effect of mold oscillation on casting skin formation and to provide reference for the terms "forward" and "reverse" strokes. FIG. 7 shows the mold assembly 18 at its lowest point in the melt 14. At this instant in time, the mold assembly would be just beginning its acceleration in the upward direction as is indicated by the small arrow 41. At this time, the upward velocity of the strand would be greater than the upward or forward velocity of the mold. It should be noted that the solidification skin 12*a* of strand 12 is very thin. FIG. 8 shows the mold assembly 10 at about the middle of its travels up and down the melt. By the time the mold assembly has reached midpoint, its upward velocity is greater than the upward velocity of the strand. This is due to an acceleration of the mold assembly in the upward direction which is about 2 g for most applications. It is again emphasized that the velocity of the strand is constant, and only the velocity of the mold assembly varies. In FIG. 8 a solidification front 29 has moved near the top of the melt. Skin 12*a* is thicker as opposed to the skin shown in FIG. 7.

FIG. 9 shows the mold at the top of its path of travel. At the particular instant depicted in FIG. 9, the mold velocity in the upward or forward direction is zero and is about to begin its trip back down to the position shown in FIG. 7. At this position, the solidification skin 12*a* is thickest. Forward and reverse speeds are separately settable in the computer to obtain optimum surface quality and material structure. In view of FIGS. 7–9 it should be apparent that the term "forward stroke" refers to the movement of the mold assembly away from the melt while the term "reverse stroke" refers to the movement of the mold assembly further into the melt.

Figure 4:
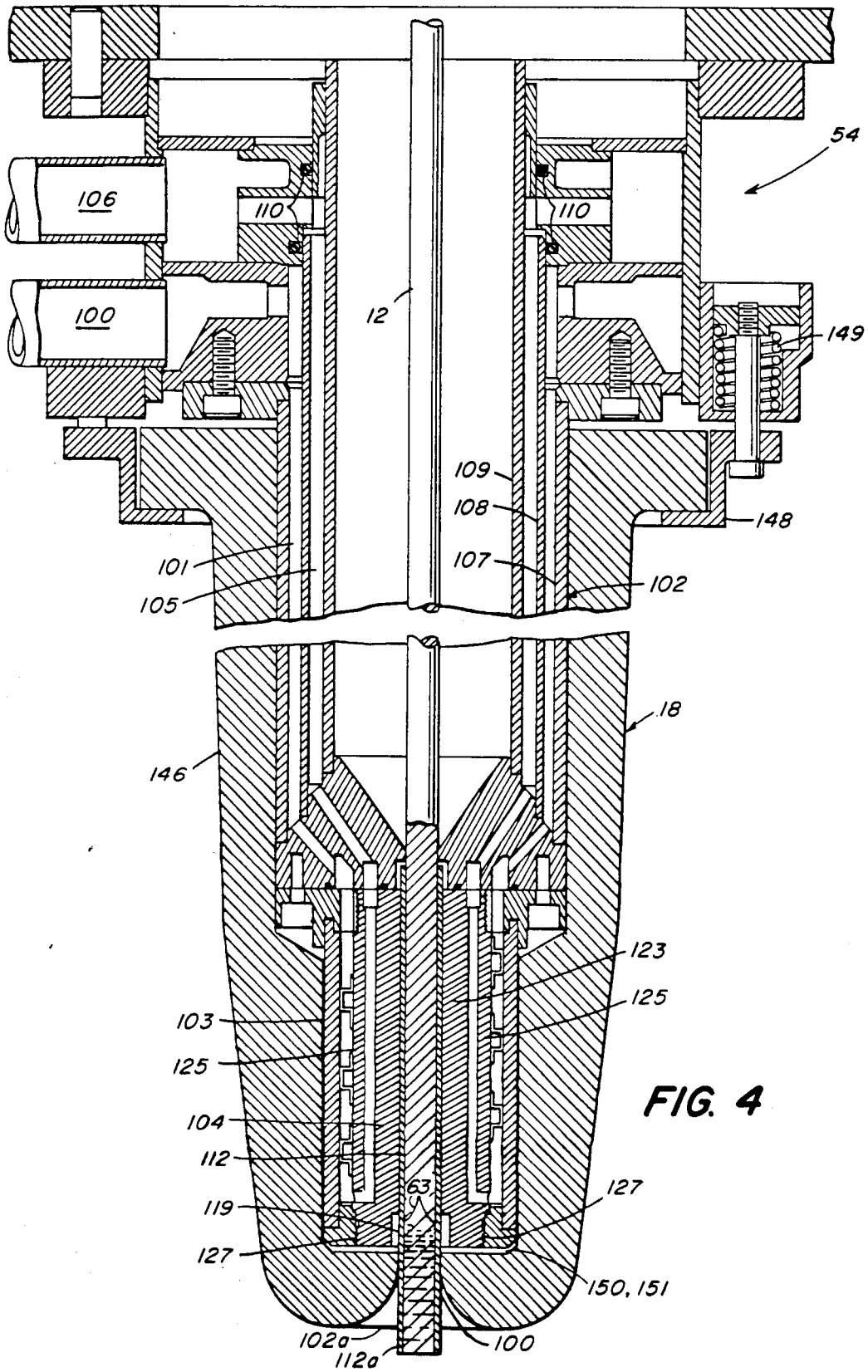
FIG. 4 is an isolated sectional view of the support manifold extension assembly and mold of the structure of FIG. 2.
Figure 5:
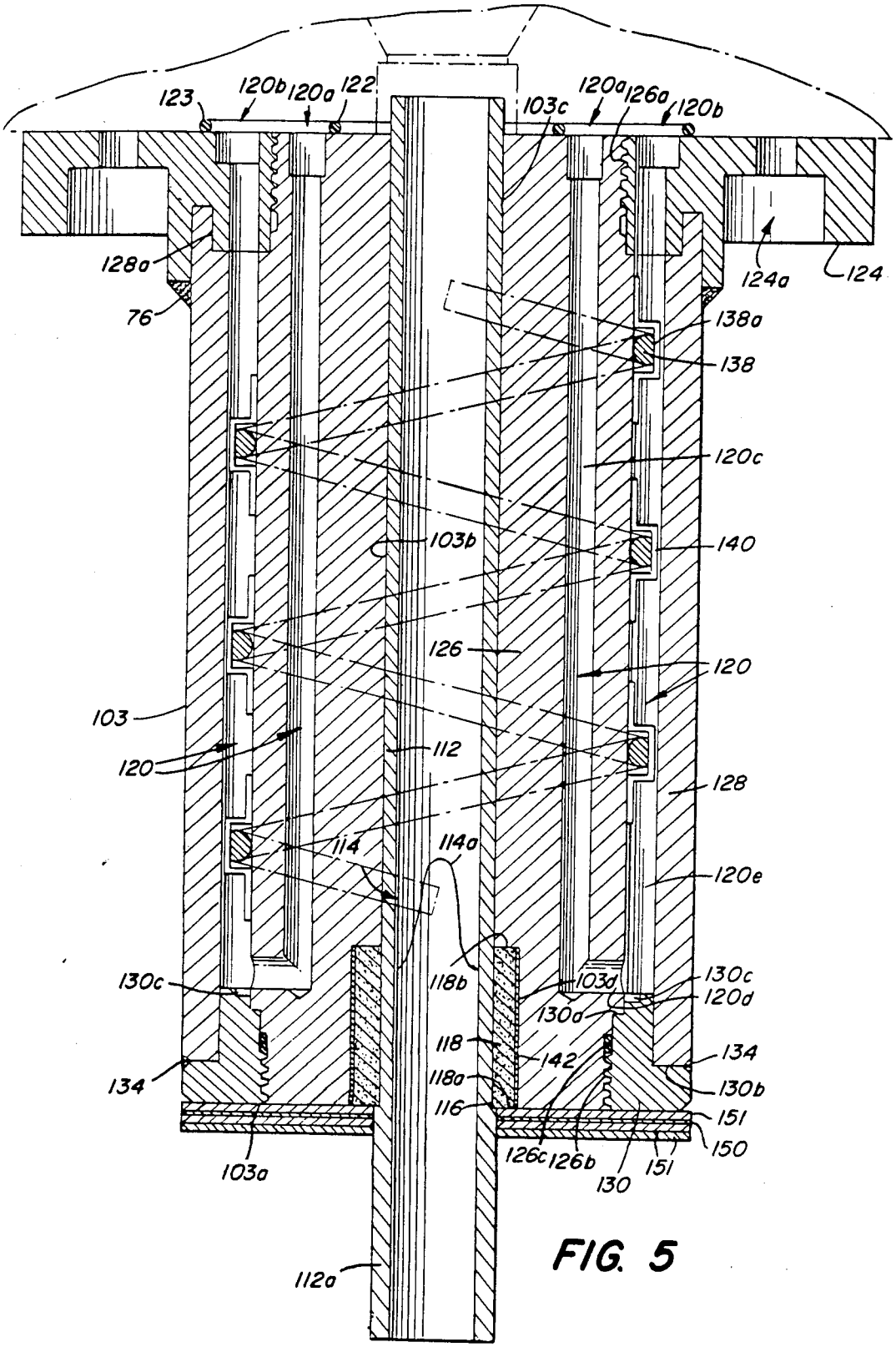
FIG. 5 is an enlarged view of the coolerbody and mold of the structure of FIG. 4.

FIGS. 4 and 5 show a preferred embodiment of the mold assembly 18 and illustrate how coolant is supplied continuously thereto. Coolant, preferably water, enters the manifold 54 at an inlet 100 and travels down an annular passageway 101 in a manifold extension assembly 102 and continues into a coolerbody 103 to cool a mold 104. The coolant returns through an annular passageway 105 and out an outlet 106. The passageways 101 and 105 are the annular spaces created by three concentric tubes 107, 108 and 109, each formed of steel. The outer tube 107 is flange mounted to the manifold 54. The two inner tubes 108 and 109 slide into O-ring gland seals 110 in manifold 54. By this arrangement, dimensional changes caused by thermal gradients are accommodated.

The concentric tube design for the manifold extension assembly 102 permits high coolant flow rates while minimizing the cross sectional area of the assembly which must oscillate within the furnace melt. Minimizing the cross sectional area is important in holding down the hydrodynamic loading on the oscillating mold assembly.

Referring now to the great detail of FIG. 5, a tubular die 112 is enclosed by the coolerbody 103. The die 112 has a lower end portion 112*a* that projects beyond the lower face 103*a* of the coolerbody. The die portion 112*a* and at least a portion of the coolerbody are immersed in the melt 14 during casting. Cuprostatic pressure forces liquid melt into the die toward the coolerbody. On start up, a length of straight rod is inserted into the die thourgh a graphite plug and positioned with its lower end, which typically holds a bolt, somewhat above a normal solidification or casting zone 114. The immersion depth is selected so that the liquid melt reaches the casting zone 114 where rapid heat transfer from the melt to the coolerbody solidifies the melt to form a solid casting without running past the starter rod. The melt adjacent the die will cool more quickly than the centrally located melt so that an annular "skin" forms around a liquid core. The liquid solid interface defines a solidification front 114*a* across the casting zone 114. It is preferred that the peak of solidification front 114*a* be always located beneath the surface of melt 14. Since solidification initiates within the area of die 112 backed by insulating bushing 118, the location of the solidification front is well defined. A principal feature of this invention is that the casting zone is characterized by a high cooling rate and a steep vertical temperature gradient at its lower end so that it extends over a relatively short length of the die 112. These features are a result of initiating solidification of the melt within the area of the die back by the insulating member or bushing 118.

It should be noted that while this invention is described with respect to a preferred upward casting direction, it can also be used for horizontal and downward casting. Therefore, it will be understood that the term "lower" means proximate the melt and the term "upper" means distal from the melt. In downcasting, for example, the "lower" end of the mold assembly will, in fact, be above the "upper" end.

The die 112 is formed of a refractory material that is substantially non-reactive with metallic and other vapors present in the casting environment especially at temperatures in excess of 2000° F. Graphite is the usual die material, although good results have also been obtained with boron nitride. More specifically, a graphite sold by the Poco Graphite Company under the trade designation DFP-3 has been found to exhibit unusually good thermal characteristics and durability. Regardless of the choice of material for the die, before installation it is preferably outgassed in a vacuum furnace to remove volatiles that can react with the melt to cause start-up failure or produce surface defects on the casting. The vacuum environment also prevents oxidation of the graphite at the high outgassing temperatures, e.g. 750° F. for 90 minutes in a roughing pump vacuum. It will be understood by those skilled in the art that the other components of the mold assembly must also be freed of volatiles, especially water prior to use. Components formed of Fiberfrax refractory material (the trade designation of the Carborundum Co. for alumina silica refractory paper material) are pretreated by heating to about 1500° F.; other components such as those formed of silica are typically heated to 350° F. to 400° F.

The die 112 has a generally tubular configuration with a uniform inner bore diameter and a substantially uniform wall thickness. The inner surface of the die is highly smooth to present a low frictional resistance to the axial or longitudinal movement of the casting through the die and to reduce wear. The outer surface of the die, also smooth, is pressure contacted with the surrounding inner surface **103*b* of the coolerbody 103 during operation. The surface 103*b*** constrains the die as it attempts to expand radially due to heating by the melt and the casting, and promotes a highly efficient heat transfer from the die to the coolerbody by the resulting pressure contact.

The fit between the die and the coolerbody is important since a poor fit, one leaving gaps, severely limits heat transfer from the die to the coolerbody. A tight fit is also important to restrain longitudinal movement of the die with respect to the coolerbody due to friction or "drag" between the casting and the die as the casting is drawn through the die. On the other hand, the die should be quickly and conveniently removable from the coolerbody when it becomes damaged or worn. It has been found that all of these objectives are achieved by machining the mating surfaces of the die and coolerbody to close tolerances that permit a "slip fit" that is, an axial sliding insertion and removal of the die. The dimensions forming the die and mating surface **103*b*** are selected so that the thermal expansion of the die during casting creates a tight fit. While the die material typically has a much lower thermal expansion coefficient ($5\times10^{-6}$ in./in./° F.) than the coolerbody, ($10\times10^{-6}$ in./in./° F.) the die is much hotter than the coolerbody so that the temperature difference more than compensates for the differences in the thermal expansion coefficients. The average temperature of the die in the casting zone through its thickness is believed to be approximately 1000° F. for a melt at 2000° F. The coolerbody is near the temperature of the coolant, usually 80° to 100° F., circulating through it.

Mechanical restraint is used to hold the die in the coolerbody during low speed operation or set-up prior to it being thermally expanded by the melt. A straightforward restraining member such as a screw or retainer plate has proven impractical because the member is cooled by the coolerbody and therefore condensed and collects metallic vapors. This metal deposit can create surface defects in the casting and/or weld the restraining member in place, which greatly impedes replacement of the die. Zinc vapor present in the casting of brass is particularly troublesome. An acceptable solution is to create a small upset or irregularity **103*c* on the inner surface 103*b* of the coolerbody, for example, by raising a burr with a nail set. A small step 116 formed on the outer surface of the die which engages the lower face 103*a* of the coolerbody (or more specifically, an "outside" insulating bushing or ring 118 seated in counterbore 103*d*** formed in the lower end of the coolerbody) indexes the die for set-up and provides additional upward constraint against any irregular high forces that may occur such as during start-up. It should also be noted that the one-piece construction of the die eliminates joints, particularly joints between different materials, which can collect condensed vapors or promote their passage to other surfaces. Also, a one-piece die is more readily replaced and restrained than a multi-section die.

Alternative arrangements for establishing a suitable tight-fitting relationship between the die and coolerbody include conventional press or thermal fits. In a press fit, a molybdenum sulfide lubricant is used on the outside surface to reduce the likelihood of fracturing the die during press fitting. The lubricant ricant also fills machining scratches of the die. In the thermal fit, the coolerbody is expanded by heating, the die is inserted and the close fit is established as the assembly cools. Both the press fit and the thermal fit, however, require that the entire mold assembly 18 be removed from the cooling water manifold to carry out the replacement of a die. This is clearly more time consuming, inconvenient and costly than the slip fit.

While the preferred form of the invention utilizes a one-piece die with a uniform bore diameter, it is also possible to use a die with a tapered or stepped inner surface that narrows in the upward direction, or a multi-section die formed of two or more pieces in end-abutting relationship. Upward narrowing is desirable to compensate for contraction of the casting as it cools. Close contact with the casting over the full length of the die increases the cooling efficiency of the mold assembly. Increased cooling is significant because it helps to avoid a central cavity caused by an unfed shrinkage of the molten center of the casting.

To minimize expense, an opposite taper can be machined on the outer surface of the die rather than on its inside surface, or the inside surface **103*b*** of the coolerbody. Thermal expansion of the die within the coolerbody bore during casting creates the desired upwardly narrowing taper on the highly smooth inner surface of the die. Multi-section dies can either have the same bore diameter or different bore diameters to create a stepped upward narrowing. To avoid troublesome accumulations of metal between the die sections, junctions between sections should occur only above the casting zone. Also, the upper section or sections above the casting zone can be press fit since the lower section is the most likely to become damaged and need replacement.

By way of illustration, but not of limitation, a one-piece die formed of Poco type graphite, suitable for casting three-fourth inch rod, has a length of approximately ten and one half inches and a uniform wall thickness of approximately one-eighth to one-fifth inch. In general, the wall thickness will vary with the diameter of the casting. The projecting die portion 112*a* typically has a length of two inches.

Figure 6:
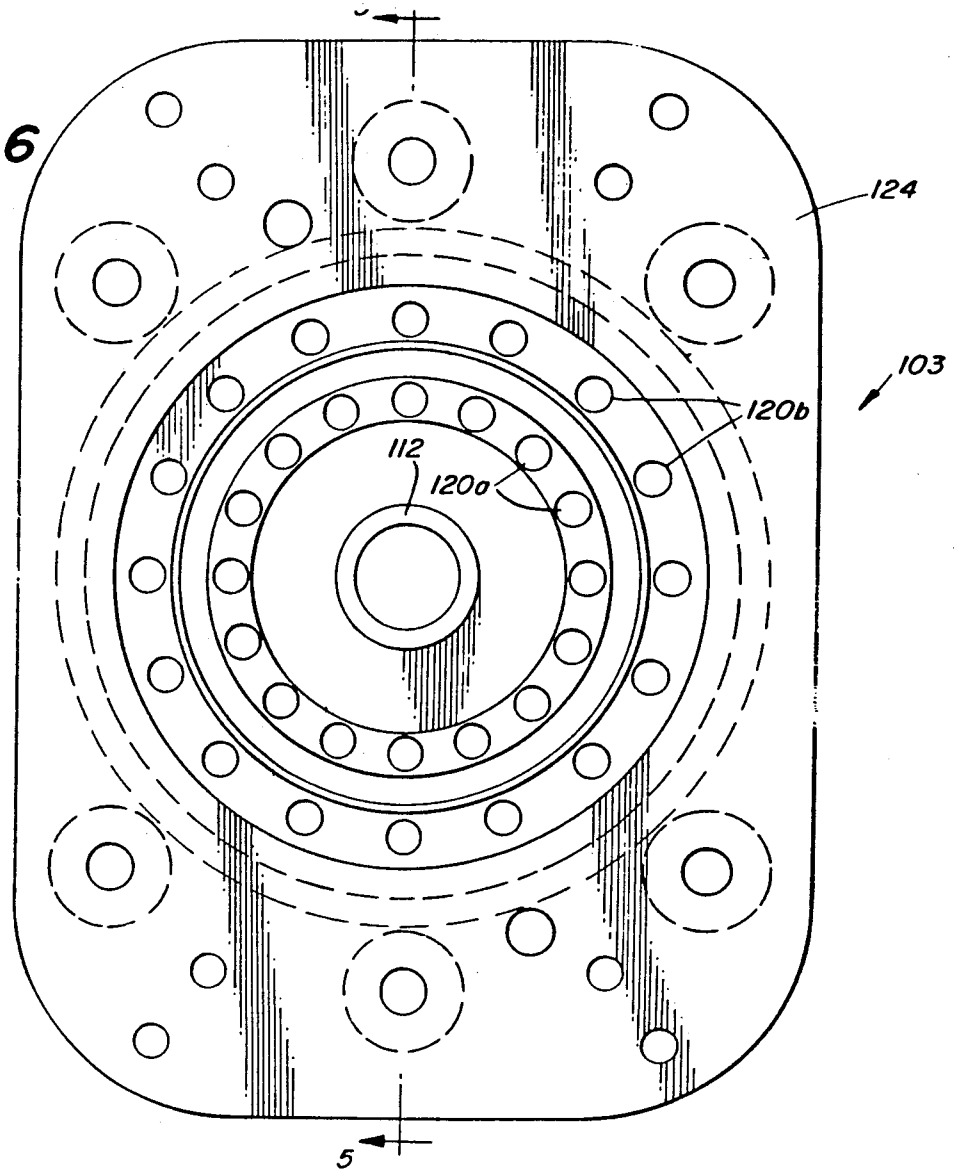
FIG. 6 is a top plan view of the coolerbody shown in FIG. 5.

The coolerbody 103 has a generally cylindrical configuration with a central, longitudinally extending opening defined by the inner surface 103*b*. The interior of the coolerbody has a passage designated generally at 120 that circulates the cooling fluid, preferably water, through the coolerbody. A series of coolant inlet openings 120*a* and coolant outlet openings 120*b* are formed in the upper end of the coolerbody. As is best seen in FIG. 6, these openings are arrayed in concentric circles with sufficient openings to provide a high flow rate, typically one gallon per pound of casting per minute. A pair of O-rings 122 and 123, preferably formed of a long wearing fluoroelastomer, seal the manifold extension assembly 102 (see FIG. 5) in fluid communication with the inlet and outlet openings. A mounting flange 124 on the coolerbody has openings 124*a* that receives bolts (not shown) to secure the mold assembly to the manifold extension assembly. This flange also includes a hole (not shown) to vent gases from the annular space between the coolerbody and an insulating hat (see FIG. 4) through a tube (not shown) in the manifold 54 to atmosphere.

The coolerbody has four gain components: an inner body 126, an outer body 128, a jacket closure ring 130 and the ounting flange 124. The inner body is formed of alloy that exhibits excellent heat transfer characteristics, good dimensional stability and is hard and wear resistant. Age hardened cooper such as the alloy designated CDA 182 preferred. The outer body 128, closure ring 130 and mounting flange 124 are preferably formed of stainless steel, particularly free machining 303 stainless for the ring 130 and flange 124, and 304 stainless for the outer body 128. Stainless exhibits satisfactory resistance to mechanical abuse, possesses similar thermal expansion characteristics as chrome copper, and holds up well in the casting environment. By the use of stainless steel, very large pieces of age hardened copper are not required, thus making manufacture of the coolerbody more practical.

The inner body is machined from a single cylindrical billet of sound (crack-free) chrome copper. Besides cost and functional durability advantages, the composite coolerbody construction is dictated by the difficulty in producing a sound billet of chrome copper, which is large enough to form the entire coolerbody. Longitudinal holes 120*c* are deep drilled in the inner body to define the inlets 120*a*. The holes 120*c* extend at least to the casting zone and preferably somewhat beyond it as shown in FIG. 5. Cross holes 120*d* are drilled to the bottom of the longitudinal holes 120*c*. The upper and lower ends of the inner body are threaded at 126*a* and 126*b* to receive the mounting flange 124 and the closure ring 130, respectively, for structural strength. The closure ring has an inner upwardly facing recess 130*a* that abuts a mating step machined on the inner body for increased braze joint efficiency, to retard the flow of cooling water into the joint, and to align the ring with the inner body. An outer, upwardly facing recess 130*b* seats the lower end of the outer body 128 in a fluid-tight relationship.

Because the threaded connection at 126*b* will leak if not sealed well and is required to withstand re-solutionizing and aging of softened coolerbody bores, the joint is also copper/gold brazed. While copper/gold brazing is a conventional technique, the following procedures produce a reliable bond that holds up in the casting environment. First, the mating surfaces of the closure ring and the inner body are copper plated. The plating is preferably 0.001 to 0.002 inch thick and should include the threads, the recess 130*a* and groove 130*c*. The braze material is then applied, as by wrapping a wire of the material around the inner body in a braze clearance 126*c* above the threads and in the groove 130*c* atop closure ring 130. Two turns of a one-sixteenth inch diameter wire that is sixty percent copper and forty percent gold is recommended in clearance 126*c* and three turns in groove 130*c*. A braze paste of the same alloy is then spread over the mating surfaces. The closure ring is tightly screwed onto the inner body and the assembly is placed in a furnace, brazed end down, and preferably resting on a supported sheet of alumina silica refractory paper material such as the product sold by Carborundum Co. under the trade designation Fiberfrax. The brazing temperature is measured by a thermocouple resting at the bottom of one of the longitudinal holes 120*c*. The furnace brings the assembly to a temperature just below the fusing point of the braze alloy for a short period of time such as 1760° F. to 1790° F. for ten minutes. The furnace atmosphere is protected (inert or a vacuum) to prevent oxidation. The assembly is then rapidly heated to a temperature that liquifies the braze alloy (1860° F. to 1900° F.) and is immediately allowed to cool to room temperature, again in a protected atmosphere. Solution treating of the chrome copper is best performed at a separate second step by firing the part to 1710° F. to 1750° F. for 15 minutes in a protected atmosphere and followed by liquid quenching.

Once the closure ring is joined to the inner body, the remaining assembly of the coolerbody involves TIG welding type 304 to type 303 stainless steel using type 308 rod after preheating parts to 400° F. The outer body 128, which has a generally cylindrical configuration, is welded at 134 to the closure ring. The upper end of the outer body has an inner recess 128*a* that mates with the mounting flange 124 just outside the water outlet openings 120*b*. A weld 136 secures those parts. The closure ring and mounting flange space the outer body from the inner body to define an annular water circulating passage 120*e* that extends between the cross holes 120*d* and the outlet openings 120*b*. A helical spacer 138 is secured in the passage 120*e* to establish a swirling water flow that promotes a more uniform and efficient heat transfer to the water. The spacer 138 is preferably formed of one-fourth inch copper rod. The spacer coil is filed flat at points 138*a* to allow clearance for holding clips 140 secured to the inner body. A combination aging (hardening) treatment of the chrome copper and stress relief of the welded stainless steel is accomplished at 900° for at least two hours in a protected atmosphere. The coolerbody is then machined and leak tested.

By way of illustration only, cooling water is directed through the inlets 120*a*, the holes 120*c* and 120*d*, and the spiral flow path defined by the passage 120*e* and the spacer 138 to the outlets 120*b*. The water is typically at 80° F. to 90° F. at the inlet and heats approximately ten to twenty degrees during its circulation through the coolerbody. The water typically flows at a rate of about one gallon per pound of strand solifified in the casting zone per minute. A typical flow rate is 25 gallons per minute. The proper water temperature is limited at the low end by the condensation of water vapor. On humid days, condensation can occur at 70° F. or below, but usually not above 80° F. Water temperatures in excess of 120° F. are usually not preferred. It should be noted that the inlet and outlet holes can be reversed; that is, the water can be applied to the outer ring of holes 120*b* and withdrawn from the inner ring of holes 120*a* with no significant reduction in the cooling performance of the coolerbody. The spacing between the die and the inner set of holes is, however, a factor that affects the heat transfer efficiency from the casting to the water. For a three-fourths inch strand 12, the spacing is typically approximatelv ⅝ inch. This allows the inner body 126 to be rebored to cast a one inch diameter strand and accept a suitably dimensional outside insulator 118. In general, the aforedescribed mold assembly provides a cooling rate that is high compared to conventional water jacket coolers for chilled mold casting in closed systems.

Another important feature of this invention is the outside insulating bushing 118 which ensures that the die is dimensionally uniform in the casting zone and prevents an excessive outward expansion of the die below the zone (bell-mouthing) that can lead to termination, start up defects, or surface defects. The bushing 118 is also important in creating a steep axial die temperature gradient immediately below the casting zone. For example, without the bushing 118, a sharp temperature gradient would exist at the entrance of the die into the coolerbody causing the lower portion 112*a* of the die to form a bell-mouth casting skin. The enlarged portion cannot be drawn into the coolerbody past the casting zone. It wedges, breaks off from the casting, and can remain in place as casting continues. This wedged portion can result in poor surface quality or termination of the strand. The bushing 118 prevents this problem by mechanically restraining the outward expansion of the die immediately below the casting zone 114. It also insulates the die to a great extent from the coolerbody to create a gentle thermal gradient in the die over the region extending from the lower coolerbody face 103*a* to somewhat below the lower edge of the casting zone 114.

The bushing 118 is formed of a refractory material that has a relatively low coefficient of thermal expansion, a relatively low porosity, and good thermal shock resistance. The low coefficient of thermal expansion limits the outward radial pressures exerted by the bushing on the coolerbody and, with the coolerbody, constrains the graphite to maintain a substantially uniform die inner diameter. The low coefficient of thermal expansion also allows the bushing 118 to be easily removed from the coolerbody by uniformly heating the assembly to 250° F. A suitable material for the bushing 118 is cast silica glass ($SiO_2$) which is machinable.

The bushing 118 extends vertically from a lower end surface 118*a* that is flush with the lower cooler body face 103*a* to an upper end surface 118*b* somewhat above the lower edge of the casting zone. In the production of three-fourths inch brass rod, a bushing having a wall thickness of approximately one-fourth inch and a length of one and three-eighths inches has yielded satisfactory results.

In practice, it has been found that metallic vapors penetrate between the inside insulating bushing 118 and the coolerbody counterbore 103*d*, condense and bond the ring to the coolerbody making it difficult to remove. A thin foil shim 142 of steel placed between the ring and the counterbore solves this problem. The bushing and the shim are held in the counterbore by a special thermal fit, that is, one which allows easy assembly and removal when the bushing and the coolerbody are heated to 400° F.

Figure 11:
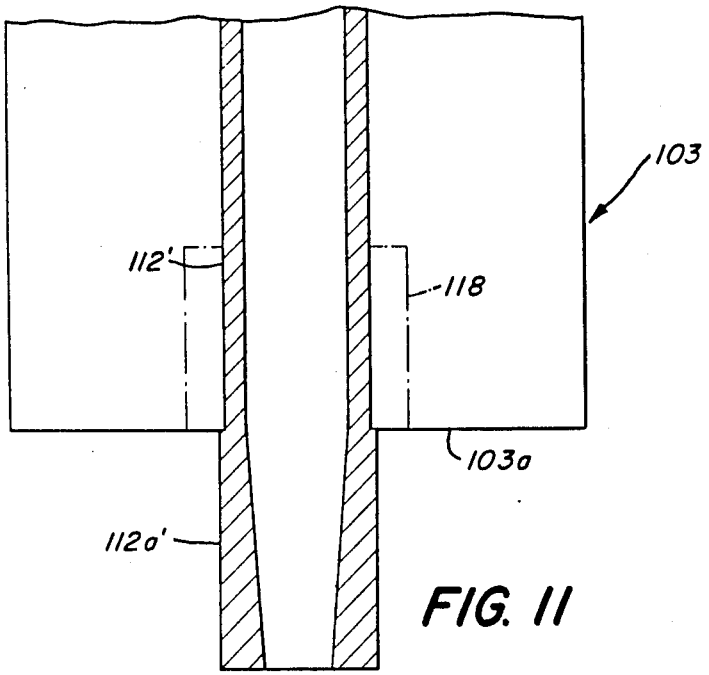
FIGS. 11 and 12 are simplified views in vertical section of alternative arrangements for controlling the expansion of the die below the casting zone.
Figure 12:
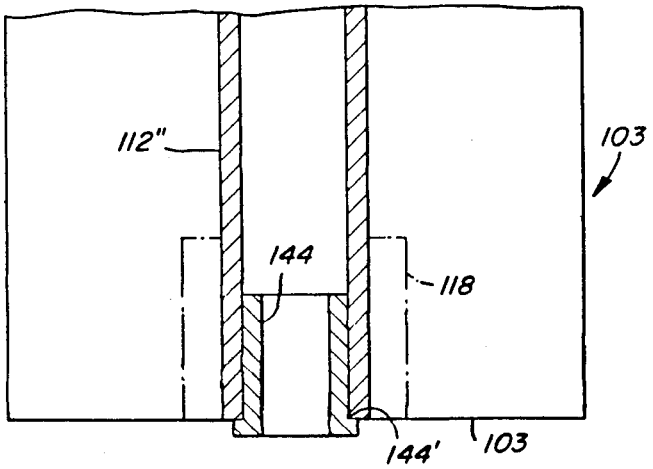

FIGS. 11 and 12 illustrate alternative arrangements for ensuring that the casting occurs in a dimensionally uniform portion of the die and for controlling the expansion of the die below the casting zone. FIG. 11 shows a die 112' which is identical to the die 112, except that the projecting lower portion 112*a* has an upwardly expanding taper formed on its inner surface. The degree of taper is selected to produce a generally uniform diameter bore when the die portion expands in the melt. This solution, however, is difficult to fabricate. Also, in practice, it is nevertheless necessary to use the bushing 118 (shown in phantom) as well as the die 112' to achieve the high production speeds and good casting quality characteristics of this invention.

FIG. 12 shows an "inside" insulator 144 that slips inside a die 112" which is the same as the die 112 except that it is terminated flush with the coolerbody face 103*a*. The inside insulator 144 is formed of refractory material that does not react with the molten metal and has a relatively low thermal expansion so that it does not deform the coolerbody. The lower end of the insulator 144 extends slightly beyond the lower end of the die 112" and the coolerbody while it has an enlarged outer diameter to form a step 144' similar in function to the step 116 on the die 112. The upper end should be placed near the lower end of the casting zone, usually ½ inch below the upper edge of the bushing 118. If the upper end extends too high, relative to the outside insulator, the strand will cast against the insulator leaving indentations in the strand. The bore dimensions of the inside insulator are also significant, particularly on startup, during a hold, or during a slow down, because the melt begins to solidify on the inside insulator 144. To prevent termination, the inner surface of the insulator 144 must be smooth and tapered to widen upwardly. As with the die 112', the outside insulator or bushing 118 is used in conjunction with the inside insulator 144 to reduce the aforementioned difficulties.

Referring again to FIG. 4, a ceramic hat 146 surrounds the coolerbody 103 and the manifold extension assembly 102 to insulate them thermally from the metallic melt, so that the coolerbody may perform its function of cooling the mold so that rod solidification may occur. The hat 146 is formed from any suitable refractory material such as cast silica. The hat 146 attaches to the manifold 54 by means of a ring 148 which is spring biased against the manifold 54 by a spring 149. By this means of attachment, the hat 146 is pulled tightly against the coolerbody 103 while allowing for dimensional changes from differential thermal expansion. The spring 149 is preloaded to create a total force greater than the highest G loading to be experienced during oscillation, thereby maintaining a tight seal between the hat 146 and the coolerbody 103. The hat allows the mold assembly to be immersed in the melt to any preselected depth. While immersion to a level below the casting zone is functional, the extremely high production speed characteristics are, in part, a result of a relatively deep immersion, at least to the level of the casting zone. One advantage of this deep immersion is to facilitate feeding the melt to the liquid core of the casting in the casting zone.

A vapor shield 150 and gaskets 151 (see also FIG. 5) are placed in the gap between the hat and the coolerbody adjacent the die to prevent the melt and vapors from entering the gap and to further thermally insulate the coolerbody. The gaskets are preferably three or four annular layers or "donuts" of the aforementioned Fiberfrax refractory fiber material, while the vapor shield is preferably a "donut" of molybdenum foil interposed between the gaskets 151. The shield 150 and gaskets 151 extend from the die extension 112*a* to the outer diameter of the coolerbody. The combined thickness of these layers is sufficient to firmly engage the coolerbody face 103*a* and the end face of the hat 146 typically one-fourth inch.

In a typical cycle of operation, the casting furnace 16 is filled with a molten alloy. A rigid, stainless steel rod is used to start up the casting. A steel bolt is screwed into the lower end of the rod. The rod has the dimensions of the strand to be cast, e.g. three-fourths inch diameter rod, so that the rod can be fed down through the mold assembly and can be engaged by the withdrawal machine 22.

Whenever the mold assembly is inserted into the melt, a cone of a material non-contaminating to the melt being cast, preferably solid graphite, covers the die portion 112*a* (or a refractory die extension such as the inside insulator 144). An additional alloy cone 48 of a material non-contaminating to the melt, typically copper, covers the lower end of the hat 146. The cones pierce the cover and dross on the surface of the melt to reduce the quantity of foreign particles caught under the coolerbody and in the die. The melt dissolves the cone 48 and the starter rod bolt pushes the smaller graphite cone off the die and it floats to the side. An advantage of the preferred form of this invention, utilizing a projecting die portion 112*a*, is that it supports and locates the smaller graphite cone on insertion into the melt. To function properly, the surface of the larger cone 48 should form an angle of forty-five degrees or less with the vertical.

After the graphite cone has been displaced, the bolt extends into the melt and the melt solidifies on the bolt. During start up and after the strands have advanced sufficiently above the drive wheels 44, the cast rod is sheared below the steel bolt and the strands are mechanically diverted onto the booms 24, 24'. Before replacing the starter rods in a storage rack for reuse, the short length of casting and the steel bolt is removed. An alternative starter rod design uses a short length of rigid stainless steel rod attached to a flexible cable which can be fed directly onto the boom 24 because of its flexibility. The withdrawal machine is then ramped up to a speed to begin the casting. Between shifts or during temporary interruptions, such as for replacement of a coiler, the strand is stopped and clamped. Casting is resumed simply by unclamping and ramping up to full speed.

As the strand 12 is withdrawn, forward strokes pull the solidified casting formed in the casting or solidification zone upwardly to expose melt to the cooled die, which quickly forms a skin on this newly exposed die surface. During steady state operation, the rod is pulled at a constant rate in the range from 200 to 400 inches per minute. Simultaneously, the entire mold assembly, including the enclosed die 112, is oscillated vertically with an acceleration of about 1 g, reaching a top speed of about four inches per second in each direction. The oscillation : allows the new skin to strengthen and attach to the previously formed casting. Because of the high cooling rate of the coolerbody and the steep temperature gradient generated by the outside insulator 118, the solidification occurs very rapidly over a relatively short length of the die. As stated earlier, typical melt temperatures for oxygen free cooper and copper alloys are 1900° F. to 2300° F. In practicing the present invention, the insulator (bushing 118) insulate the melt from the coolerbody to maintain the melt as a liquid within the die below the casting zone. Near the upper edge of the insulator the melt temperature drops rapidly an solidification begins. In casting three-fourths inch brass rod at over 100 ipm, the casting zone extends longitudinally for 1 to 1½ inches. At the top of the casting zone, the strand is solid. Estimated average temperature of brass castings in the solidification zone are 1650° F. to 1750° F. A typical temperature for the brass casting as it leaves the mold assembly is 1500° F. At the upper end of the mold assembly, there is a clearance around the strand to ensure the presence of oxygen or a water saturated atmosphere to burn off zinc vapors before they condense and flow down to the casting zone. The strand, thus produced, is of exceptionally good quality. The strand is characterized by a fine grain size and dendrite structure, good tensile strength and good ductility.

There has been described a simple, low cost oscillating mold assembly and a withdrawal process for use with the mold assembly that are capable of continuously producing high quality metallic strands, particularly brass, at extraordinarily high speeds. In particular, the mold assembly and withdrawal process provide sophisticated solutions to the many serious difficulties attendant the casting environment such as extreme temperatures and temperature differentials, metallic and water vapors, foreign particles present in the casting furnace and differentials in the thermal expansion coefficients of the materials forming the mold asembly.

The invention is further illustrated by the following non-limiting example.

Using the apparatus illustrated in FIG. 2 of the drawing, strand 12 was continuously cast from a melt of free-cutting brass, CDA 360. 4400 lbs. of the molten alloy was charged into furnace 16 and was maintained in the molten state. The composition for alloy CDA 360 is:

| Lead | Weight Percent |
|---|---|
| Lead | 2.5–3.7 |
| Copper | 60.0–63.0 |
| Iron | 0–0.35 |
| Impurities | 0–0.5 |
| Zinc | balance |

After initiating casting of a strand 12 by insertion of a pipe with a screw on its end through die 112 into the melt followed by withdrawal of the pipe in the manner known in this art, the solidified strand 12 was drawn by rollers 44 at a speed of 200 inches per minute. At the initiation of continous withdrawal of strand 12, the body 18 of the oscillating mold was immersed in the melt to a depth of about 5 inches. During casting, the dunk depth of body 18 varied from approximately 7 inches to 3 inches immersion. During mold oscillation, the temperature of the melt was maintained at 1850° F. and molten alloy was fed into furnace 16 as needed during casting to maintain the immersion depths of body 18. The diameter of the die 15 was 0.75 inches to produce strand 12 with a diameter of about 0.75 inches. The forward and reverse mold speed during oscillation reached a top value of 4 inches per second due to a mold acceleration of 1 g. The distance the mold travelled between its uppermost position in the melt and its bottommost position was approximately 1.75 inches. The temperature of the strand 12 as it left the die 112 was approximately 1500° F.

After casting, the rod was hot fabricated successfully. Cast grain size was from columnar, 1 mm. Wrought structure was fine recrystallized throughout the section (0.025–0.050 mm).

While the invention has been described with reference to its preferred embodiments, it will be understood that modifications and variations will occur to those skilled in the art. For example, while the die 112 has been described as extending the full length of the coolerbody 103, for many applications it can extend only a short distance above the casting zone. Also, the coolerbody can assume a variety of alternative configurations and dimensions. Such modifications and variations are intended to fall within the scope of the appended claims.

What is claimed and desired to be secured by Letters Patent is:

1. Apparatus for continuously casting a metallic strand from a metallic melt, comprising:

a generally tubular die having a first end in fluid communication with the melt;

a coolerbody having a first end surrounding a portion of said die to enable portions of said die to be cooled;

an insulating member located between a portion of said die and said coolerbody to insulate a portion of said die from the cooling of said coolerbody, the location of said insulating member being at said first end of the coolerbody and extending between said die and said coolerbody a first distance;

means for immersing said first end of said coolerbody in the melt a distance greater than said first distance to produce a solidification front within the die when the melt is withdrawn through said coolerbody;

means for withdrawing molten metal from the melt through said die while cooling said die through said coolerbody, said cooling completely solidifying the molten metal into a strand within a portion of the die above the insulating member, the solidified strand being withdrawn from said melt at a constant rate; and means for oscillating said die in a direction parallel to the direction of travel of said strand in a pattern of forward and reverse strokes.

2. Apparatus as set forth in claim 1 wherein said first end of the die extends beyond the first end of said coolerbody.

3. Apparatus as set forth in claim 2 wherein said die has an inside surface which tapers with the inside surface widening in a direction away from said first end, towards said insulating member and wherein the heat from said melt expands said die during casting to produce a uniform inside diameter throughout said die when the melt is withdrawn through said die.

4. Apparatus as set forth in claim 1 further comprising means for circulating a cooling fluid through said coolerbody to a point just above the top of the insulating member to initiate solidification of the melt into a strand within the portion of the die backed by said insulating member and to completely solidify said melt into a strand within a portion of the die above the insulating member.

5. Apparatus as set forth in claim 2 further comprising means for circulating a cooling fluid through said coolerbody to a point just above the top of the insulating member to initiate solidification of the melt into a strand within the portion of the die backed by said insulating member and to completely solidify said melt into a strand within a portion of the die above the insulating member.

6. Apparatus as set forth in claim 3 further comprising means for circulating a cooling fluid through said coolerbody to a point just above the top of the insulating member to initiate solidification of the melt into a strand within the portion of the die backed by said insulating member and to completely solidify said melt into a strand within a portion of the die above the insulating member.

7. Apparatus as set forth in claim 4 wherein the part of said coolerbody that is immersed in said melt is protected from the heat of the melt by an insulating material, said insulating material forming an insulating barrier between the melt and the coolerbody.

8. Apparatus as set forth in claim 5 wherein the part of said coolerbody that is immersed in said melt is protected from the heat of the melt by an insulating material, said insulating material forming an insulating barrier between the melt and the coolerbody.

9. Apparatus as set forth in claim 6 wherein the part of said coolerbody that is immersed in said melt is protected from the heat of the melt by an insulating material, said insulating material forming an insulating barrier between the melt and the coolerbody.

10. Apparatus as set forth in claim 4 further comprising an annular circulation path for the travelling cooling fluid, said path formed between inner and outer space walls in said coolerbody.

11. Apparatus as set forth in claim 5 further comprising an annular circulation path for the travelling cooling fluid, said path formed between inner and outer space walls in said coolerbody.

12. Apparatus as set forth in claim 6 further comprising an annular circulation path for the travelling cooling fluid, said path formed between inner and outer space walls in said coolerbody.

13. Apparatus as set forth in claim 7 further comprising an annular circulation path for the travelling cooling fluid, said path formed between inner and outer space walls in said coolerbody.

14. Apparatus as set forth in claim 10 wherein said inner wall is formed of a copper alloy and said outer wall is formed of stainless steel.

15. Apparatus as set forth in claim 11 wherein said inner wall is formed of a copper alloy and said outer wall is formed of stainless steel.

16. Apparatus as set forth in claim 12 wherein said inner wall is formed of a copper alloy and said outer wall is formed of stainless steel.

17. Apparatus as set forth in claim 13 wherein said inner wall is formed of a copper alloy and said outer wall is formed of stainless steel.

18. Apparatus according to claim 10 wherein a helical element is disposed in said spacing to produce a swirling fluid flow.

19. Apparatus according to claim 11 wherein a helical element is disposed in said spacing to produce a swirling fluid flow.

20. Apparatus according to claim 12 wherein a helical element is disposed in said spacing to produce a swirling fluid flow.

21. Apparatus according to claim 13 wherein a helical element is disposed in said spacing to produce a swirling fluid flow.

22. Apparatus according to claim 14 wherein a helical element is disposed in said spacing to produce a swirling fluid flow.

23. Apparatus according to claim 15 wherein a helical element is disposed in said spacing to produce a swirling fluid flow.

24. Apparatus according to claim 16 wherein a helical element is disposed in said spacing to produce a swirling fluid flow.

25. Apparatus according to claim 17 wherein a helical element is disposed in said spacing to produce a swirling fluid flow.

26. Apparatus as set forth in claim 1 further comprising means for circulating water as the cooling fluid at a temperature within the range of 70° F. to 120° F. at a rate of about one gallon of water per pound of said strand solidified in said die per minute.

27. Apparatus as set forth in claim 1 wherein a cone of a material that is noncontaminating to the melt is provided over said first die end and said cone melts after said first die end is immersed in said melt.

28. Apparatus as set forth in claim 2 wherein a cone of material that is noncontaminating to the melt is provided over said first die end and said cone melts after said first die end is immersed in said melt.

29. Apparatus as set forth in claim 6 wherein a cone of a material that is noncontaminating to the melt is provided over said first die end and said cone melts after said first die end is immersed in said melt.

30. Apparatus as set forth in claim 7 wherein a cone of a material that is noncontaminating to the melt is provided over said first die end and said cone melts after said first die end is immersed in said melt.

31. Apparatus as set forth in claim 14 wherein a cone of a material that is noncontaminating to the melt is provided over said first die end and said cone melts after said first die end is immersed in said melt.

32. Apparatus as set forth in claim 1 further comprising means for continuously adjusting the height of said melt with respect to said coolerbody.

33. Apparatus as set forth in claim 2 further comprising means for continuously adjusting the height of said melt with respect to said coolerbody.

34. Apparatus as set forth in claim 6 further comprising means for continuously adjusting the height of said melt with respect to said coolerbody.

35. Apparatus as set forth in claim 7 further comprising means for continuously adjusting the height of said melt with respect to said coolerbody.

36. Apparatus as set forth in claim 14 further comprising means for continuously adjusting the height of said melt with respect to said coolerbody.

37. Apparatus as set forth in claim 27 further comprising means for continuously adjusting the height of said melt with respect to said coolerbody.

38. Apparatus as set forth in claim 32 wherein said means for continuously adjusting the height of said melt comprises an elevator which rises in response to a signal related to the weight of the melt.

39. Apparatus as set forth in claim 33 wherein said means for continuously adjusting the height of said melt comprises an elevator which rises in response to a signal related to the weight of the melt.

40. Apparatus as set forth in claim 34 wherein said means for continuously adjusting the height of said melt comprises an elevator which rises in response to a signal related to the weight of the melt.

41. Apparatus as set forth in claim 35 wherein said means for continuously adjusting the height of said melt comprises an elevator which rises in response to a signal related to the weight of the melt.

42. Apparatus as set forth in claim 36 wherein said means for continuously adjusting the height of said melt comprises an elevator which rises in response to a signal related to the weight of the melt.

43. Apparatus as set forth in claim 37 wherein said means for continuously adjusting the height of said melt comprises an elevator which rises in response to a signal related to the weight of the melt.

44. Apparatus as set forth in claim 1 further comprising means for withdrawing said strand from said die with a withdrawal rate of up to 200 to 400 inches per minute.

45. Apparatus as set forth in claim 2 further comprising means for withdrawing said strand from said die with a withdrawal rate of up to 200 to 400 inches per minute.

46. Apparatus as set forth in claim 6 further comprising means for withdrawing said strand from said die with a withdrawal rate of up to 200 to 400 inches per minute.

47. Apparatus as set forth in claim 7 further comprising means for withdrawing said strand from said die with a withdrawal rate of up to 200 to 400 inches per minute.

48. Apparatus as set forth in claim 14 further comprising means for withdrawing said strand from said die with a withdrawal rate of up to 200 to 400 inches per minute.

49. Apparatus as set forth in claim 38 further comprising means for withdrawing said strand from said die with a withdrawal rate of up to 200 to 400 inches per minute.

50. Apparatus as set forth in claim 44 further comprising means for oscillating said die with an acceleration of about 1 g in each direction reaching a top speed of about 4 inches per second.

51. Apparatus as set forth in claim 45 further comprising means for oscillating said die with an acceleration of about 1 g in each direction reaching a top speed of about 4 inches per second.

52. Apparatus as set forth in claim 46 further comprising means for oscillating said die with an acceleration of about 1 g in each direction reaching a top speed of about 4 inches per second.

53. Apparatus as set forth in claim 47 further comprising means for oscillating said die with an acceleration of about 1 g in each direction reaching a top speed of about 4 inches per second.

54. Apparatus as set forth in claim 48 further comprising means for oscillating said die with an acceleration of about 1 g in each direction reaching a top speed of about 4 inches per second.

55. Apparatus as set forth in claim 49 further comprising means for oscillating said die with an acceleration of about 1 g in each direction reaching a top speed of about 4 inches per second.

56. Apparatus as set forth in claim 50 further comprising means for oscillating said die at a frequency of oscillation in the range of 12 to 300 cycles per minute.

57. Apparatus as set forth in claim 51 further comprising means for oscillating said die at a frequency of oscillation in the range of 12 to 300 cycles per minute.

58. apparatus as set forth in claim 52 further comprising means for oscillating said die at a frequency of oscillation in the range of 12 to 300 cycles per minute.

59. Apparatus as set forth in claim 53 further comprising means for oscillating said die at a frequency of oscillation in the range of 12 to 300 cycles per minute.

60. Apparatus as set forth in claim 54 further comprising means for oscillating said die at a frequency of oscillation in the range of 12 to 300 cycles per minute.

61. Apparatus as set forth in claim 55 further comprising means for oscillating said die at a frequency of oscillation in the range of 12 to 300 cycles per minute.

62. Apparatus as set forth in claim 1 wherein said die extends in a vertical direction and is positioned at least in part above the melt so that solidified metal is withdrawn in a vertical direction.

63. Apparatus as set forth in claim 1 wherein the dimensions of said die are sufficient to allow brass to be formed into a strand with a diameter in the range of ¼ to 2 inches with the casting speed in the range of 200 to 400 inches per minute.

64. Apparatus as set forth in claim 1 further comprising means for withdrawing said solidified rod at a speed of at least 80 inches per minute.

65. Apparatus as set forth in claim 1 further comprising means for restraining said die against vertical movement with respect to said coolerbody before said die is heated by said melt.

* * * * *